US006298634B1

(12) United States Patent
Cramer

(10) Patent No.: US 6,298,634 B1
(45) Date of Patent: Oct. 9, 2001

(54) PROCESS AND DEVICE FOR PRODUCING A WOUND ROLL THAT IS WRAPPED ON ITS CIRCUMFERENCE, AND THE WOUND ROLL

(75) Inventor: Dirk Cramer, Duisburg (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/325,742

(22) Filed: Jun. 4, 1999

(30) Foreign Application Priority Data

Jun. 10, 1998 (DE) ..... 198 25 788

(51) Int. Cl.[7] ..... B65B 61/00
(52) U.S. Cl. ..... 53/410; 53/389.4
(58) Field of Search ..... 53/410, 449, 461, 53/450, 465, 472, 139.5, 139.6, 139.7, 476, 129.1, 168, 172, 211, 389.3, 389.4, 373.4, 389.2, 214; 83/100, 102; 242/167, 364.4, 475.1, 551, 555

(56) References Cited

U.S. PATENT DOCUMENTS

| | | | | |
|---|---|---|---|---|
| 1,351,809 | * | 9/1920 | Sutherland | 53/214 |
| 1,858,540 | * | 5/1932 | Doering et al. | 53/172 |
| 2,638,725 | * | 5/1953 | Hurter et al. | 53/214 |
| 2,893,191 | * | 7/1959 | Lancaster | 53/465 |
| 3,019,573 | * | 2/1962 | Navikas | 53/172 |
| 3,216,457 | * | 11/1965 | Zavasnik | 53/172 |
| 3,325,071 | * | 6/1967 | Schmitz | 53/172 |
| 3,494,095 | * | 2/1970 | Valvano | 53/465 |
| 3,678,646 | | 7/1972 | Clark . | |
| 4,437,293 | * | 3/1984 | Sanborn, Jr. | 53/412 |
| 4,729,211 | * | 3/1988 | Sakurai | 53/465 |
| 4,736,567 | * | 4/1988 | Pienta | 53/214 |
| 4,882,892 | * | 11/1989 | Pienta | 53/214 |
| 5,050,469 | * | 9/1991 | Snelling | 83/102 |
| 5,257,492 | * | 11/1993 | Watts | 53/472 |
| 5,533,321 | * | 7/1996 | Hooper et al. | 53/211 |
| 5,628,167 | * | 5/1997 | Huson et al. | 53/465 |
| 5,653,089 | * | 8/1997 | Weder | 53/465 |
| 5,899,129 | * | 5/1999 | Sumida et al. | 83/102 |

FOREIGN PATENT DOCUMENTS

| | | |
|---|---|---|
| 449505 | 9/1927 | (DE) . |
| 1461821 | 2/1969 | (DE) . |
| 1586019 | 4/1970 | (DE) . |
| 4116963 | 11/1992 | (DE) . |
| 19530257 | 2/1997 | (DE) . |
| 672900 | 5/1952 | (GB) . |
| 97/49610 | 12/1997 | (WO) . |

* cited by examiner

*Primary Examiner*—Ira S. Lazarus
*Assistant Examiner*—John Paradiso
(74) *Attorney, Agent, or Firm*—Greenblum & Bernstein, P.L.C.

(57) ABSTRACT

Process for producing a wound roll that is wrapped on its circumference, an apparatus for winding and wrapping the wound roll, and the wrapped wound roll. The process includes winding a material web into the wound roll, attaching a wrapping web to the material web, and winding the wrapping web attached to the material web around the circumference of the wound roll. The apparatus includes a material web delivery path, a winding device, and an output path of a packaging web dispenser that feeds into the material web delivery path. The wrapped wound roll that includes a wound material web having a circumference covered by a wrapping web. A width of the wrapping web which corresponds to a width of the wound roll. Moreover, the wrapping web is arranged such that in at least one section, the wrapping web is positioned radially inside of the material web.

32 Claims, 4 Drawing Sheets

PROCESS AND DEVICE FOR PRODUCING A WOUND ROLL THAT IS WRAPPED ON ITS CIRCUMFERENCE, AND THE WOUND ROLL

CROSS-REFERENCE TO RELATED APPLICATIONS

The present application claims priority under 35 U.S.C. § 119 of German Patent Application No. 198 25 788.0, filed on Jun. 10, 1998, the disclosure of which is expressly incorporated by reference herein in its entirety.

BACKGROUND OF THE INVENTION

1. Field of the Invention

The present invention relates to a process for producing a material web (wound) roll that is wrapped on its circumference. A material web is wound into the wound roll and a wrapping (packaging) web or sheet is placed around the circumference of the wound roll. The present invention also relates to an apparatus for producing a wound roll that is wrapped on its circumference, in which the apparatus includes a material web delivery path and a winding device. The present invention also relates to a wound roll, formed by a wound material web, having a circumference enclosed by a wrapping web.

2. Discussion of Background Information

In one of the final production steps, a material web, e.g., a paper web, is wound into a marketable wound roll and subsequently wrapped with a wrapping (packaging) web or sheet. Generally, it is necessary to cut the finished web to certain widths which correspond to the uses for the consumer. That is, while webs are produced with widths of up to approximately 10 m, consumers, such as printing plants, require webs having maximum widths of approximately 3.8 m. In many instances, the rolls to be used by consumers have an even smaller width. Therefore, the finished web having a large width can be unwound from a main roll and guided to pass through a longitudinal cutting device to produce partial webs having the desired widths. The partial webs can then be wound into separate (partial) wound rolls.

When the separate wound rolls have attained a desired diameter, the last layer of the material web is glued to the circumference of the wound roll. The wound rolls are then ejected from the winding device and delivered to a wrapping device. In the wrapping device, the circumference of the wound roll is covered with a wrapping (packaging) web or sheet, e.g., wrapping paper, and the ends of the separate wound rolls are provided with end covers.

The wrapping device generally requires a relatively large amount of space. In many cases, the wrapping device must store a large number of wrapping web rolls of different widths to enable wrapping wound rolls produced with different widths.

SUMMARY OF THE INVENTION

The present invention reduces the amount of space necessary for operating a wrapping device for a wound roll of a material web.

The present invention provides a process in which the wrapping web is attached to the incoming material web and the material web (wound) roll is further rotated.

According to the present invention, the processes of winding and wrapping the circumference of the wound roll are combined in one location, which saves space because, e.g., the supply device for the wrapping web can be kept relatively simple. The supply of the wrapping web to the material web is provided simply by attaching the wrapping web to the material web forming the wound roll. In this manner, the material web pulls the wrapping web along, and, with further rotation of the wound roll, the wrapping web is wound around the circumference of the wound roll. Therefore, the winding device is used not only to wind the wound roll, but to produce the circumference wrapping. The present invention, therefore, has the additional advantage that the wound roll has a certain protection from damage during further handling due to the application of the wrapping web. When the wrapped wound roll is ejected from the winding device, it rolls on its circumference to other handling or transporting devices. Because the circumference is already wrapped with a wrapping web, the risk of damage to the circumference of the wound roll, i.e., the outermost layers of the material web, is reduced. By reducing the risk of damage to the wound roll, the process also reduces the number of rejects at the processor. Moreover, an additional drive mechanism for the wound roll in a separate wrapping device can be eliminated, which saves investment and maintenance costs.

It may be preferable to cut the material web in the longitudinal direction before winding and to attach the wrapping web to the material web before the cutting. In this manner, the wrapping web can also be cut in the longitudinal direction, and precisely to the width of the material web and, therefore, precisely to the width of the wound roll. Thus, the wrapping web ends flush with the end faces of the wound roll. In this manner, the desired effect that the wound roll is covered by the wrapping web on the circumference over its entire axial length is ensured, and the problems generally encountered with respect to handling an axial protrusion is avoided. Moreover, through a relatively simple measure, it is no longer necessary to store a large number of different widths of wrapping webs because the wrapping web is automatically adapted to the width of the wound roll to be wrapped. In addition to the space savings, other advantages are provided by the process of the present invention. For example, with conventional wrapping devices, it was necessary to store various widths of wrapping sheet to accommodate any desired width of wound rolls. However, the wrapping webs that are used can dry out over time, and when these dried out rolls are finally used, they can negatively affect the wrapping process due to their sharply reduced moisture. For example, the tear strength can decrease, the static load can increase, the application of adhesive can become problematic, etc. If the same wrapping web can always be used, i.e., a fresh one, as is proposed by the present invention, then these problems do not occur. Furthermore, the process of the present invention provides a considerable time savings since a number of wound rolls can be circumferentially wrapped at the same time. Thus, the time required to wrap the rolls is reduced significantly in comparison to a process in which the rolls are wrapped chronologically or successively one after the other.

The wrapping web may be preferably attached on its end to the material web. In this particular embodiment, a very stable attachment between the wrapping web and the material web can be produced. In another embodiment, the wrapping web can be used to guide the material web, e.g., to begin a new wound roll.

The wrapping web may be wound together with the material web. In this manner, the outer layers of the wound roll may be several layers of wrapping web and material web which are alternatingly arranged, i.e., in sandwich fashion.

This produces a very intimate relationship between the wrapping web and the material web, and keeps the risk of the wound roll shifting axially in the circumference wrapping (i.e.,telescoping) very low.

The material web may be glued to the surface of the wound roll in the vicinity of its attachment to the wrapping web. A second attachment to the wrapping web can occur at the end of the material web. Therefore, two gluing locations may be provided, e.g., one on a radial inside and one on the radial outside of the material web. This not only assures stable attachment of the end of the wrapping web to the circumference of the wound roll, but also assures a stable attachment of the end of the material web to the wound roll.

In an alternative embodiment, the material web may be cut in the travel direction after being attached to the wrapping web. Thus, the end of the wrapping web can be attached to the material web. In this particular embodiment, the circumference wrapping can be practically exclusively formed by the wrapping web, i.e., without interposed material web layers. However, in this embodiment, the material web follows the wrapping web so as to start winding a new material web. In particular, the wrapping web may pull the material web to the wound roll so that renewed threading procedures can be eliminated.

The wrapping web may preferably be attached to the circumference of the wound roll before a new attachment in the travel direction. Thus, the present invention provides that the beginning of a "new" material web can be pulled into the immediate vicinity of the wound roll. When the wrapping web is attached to the "old" wound roll, the wrapping web can be cut and the old wound roll can be ejected. When the winding of the new wound roll begins, a small remainder of wrapping web may be on the roll core. However, this small remainder is acceptable because the guidance of the material web into the winding device requires practically no additional expense.

The material web or wrapping web may be weakened, e.g., perforated, behind a region of attachment to the surface of the wound roll, relative to the web travel direction. Whether the material web or the wrapping web is weakened depends on whether the material web is wound together with the wrapping web onto the circumference of the wound roll or whether the material web is stopped and only the wrapping web is wound on. In the latter case, the wrapping web can be weakened and in the former case, the material web can be weakened. The weakening has the advantage that a certain tensile force can be exerted in order to pull the material web or the wrapping web into a desired position. However, if a higher tensile force is exerted in this position, the material web or the wrapping web tears off without cutting or striking off, which requires additional interventions.

The wrapping web or material web can be torn when the material web is ejected from the winding device. In this regard, it is necessary that the incoming material web, i.e., the material web to be wound into the next wound roll, be held tightly. When the completed wound roll is subsequently moved out of the winding device, relatively high forces must be exerted, which easily carry out a cutting along the weakening or perforation line.

In a particular exemplary embodiment, the wrapping web can be formed from a number of wrapping webs arranged next to one another, which overlap each other in the travel direction. The overlap region can be arranged so that it is positioned outside of an edge of the wound roll. As indicated above, main rolls from which the uncut material webs are taken have a relatively large width of up to approximately 10 m. However, wrapping webs made of wrapping paper are generally only available in widths of up to approximately 4 m. Thus, if one intends to simultaneously and similarly wrap all of the wound rolls that are cut from a main roll, this limitation on wrapping paper width could lead to problems. Of course, these problems are prevented by producing the desired width of the wrapping web from a number of sections of wrapping web arranged to overlap one another. If necessary, the adjacent wrapping webs can be glued to one another in the overlap regions. Thus, the desired large overall widths can be achieved in this manner. In addition, the overlap regions can be laid out so that they are not cut during the longitudinal cutting. In this way, the overlap regions, which have a double thickness of wrapping web, are not disposed at the edges of the wrapped wound rolls, but rather between the edges, which results in considerable advantages in the further handling. If the wound roll has a larger diameter on one axial end than on the other axial end, then the wrapped wound roll would no longer roll in a straight line when being unwound, but would instead describe an arc. It may also be possible that this effect can occur with thickened diameter disposed in the center region of the wound roll, however, it is not as critical in the mid-section of the roll if additional edge protection strips are applied, which is generally required to secure the end covers to the wrapped roll. If the edge protection strips are applied outside the thickened diameter, then their outer diameter can be made at least as great as the thickened diameter so that the wound rolls thus wrapped can once again roll in a straight line. For a short path between the winding device and a transport device, which conveys the wrapped wound roll to an edge wrapping device, the thickened diameter has no effect of any consequence.

The present invention provides an apparatus in which a wrapping web dispenser has an output path that feeds into the material web supply path.

As discussed above with reference to the process, this embodiment supplies the wrapping web to the wound roll in the same manner as the material web itself. Accordingly, complicated threading or guiding devices with which the wrapping web must be supplied to the circumference of the wound roll are avoided. Particularly, with this embodiment, the wrapping web can be pulled along by the material web (and possibly vice versa). The winding device can be utilized for at least two purposes, e.g., for winding the material web into the wound roll and for producing the rotational motion necessary to pull the wrapping web onto the circumference of the wound roll.

Preferably, a longitudinal cutting device may be located in the material web supply path and the output path feeds into the supply path before, i.e., downstream of, relative to the supply path direction, the longitudinal cutting device. As a result, the wrapping web is automatically cut to the same width as the material web such that the wrapping web has precisely the same axial span as the wound roll. Thus, the wound roll can be covered over its entire axial length by the wrapping web without any axial protrusion by the wrapping web at the wound roll end. The alignment of the wrapping web to the wound roll occurs automatically.

A first glue delivery station may preferably be located in the region of an outlet, which forms the output path. The glue delivery station can produce a glue layer or area between the wrapping web and the material web, preferably on the wrapping web. However, it is also possible to produce the glue layer on the material web. The glue layer can be produced in many different ways. For example, it is possible to apply glue or adhesive, such as hot melt, to the wrapping web or the material web, or it is also possible to use a wrapping web that is already coated with a glue that can be "activated" in the glue delivery station. Glues of this kind can be, e.g., a gumming that is made sticky with the addition of water. It can also be a hot glue that becomes sticky when it is heated.

Further, a second glue delivery station may be located in a region before a nip formed between the wound roll and one of the carrying rollers. While the first glue delivery station may be utilized to attach the wrapping web and the material web to each other, the second glue delivery station is utilized to produce an "end sheet adhesion," i.e., to glue the end of the wrapping web or the end of the material web that is attached to the wrapping web, to the circumference of the wound roll. If the radial inside surface of the material web or the wrapping web has been made sticky, then it is sufficient if this end passes through the nip between the wound roll and the carrying roller to be pressed against the outer surface of the wound roll with sufficient force.

A weakening device, e.g., a perforation device, may preferably be located in the vicinity of the second glue delivery station. The weakening device is positioned to weaken either the material web or the wrapping web in the vicinity of the adhesive applied by the second glue delivery station, but the wrapping web or material web can still be pulled after the weakening. However, separation at the weakened part of the material web or wrapping web is possible by a simple tearing. If the material web and the wrapping web are being wound jointly, then the perforation device perforates the material web after the superposed gluing of the wrapping web to the material web and of the material web to the wound roll. If the wrapping web alone is being wound on, the wrapping web is perforated between the gluing of the wrapping web to the material web (e.g., for forming the next wound roll) and the gluing of the wrapping web to the wound roll.

In an exemplary embodiment, the winding device includes a winding bed and a material web securing device is positioned in the inlet region of the winding bed. The material web securing device secures the material web in order to perform two functions, e.g., to facilitate the tearing of the material web or wrapping web when the wound roll is ejected from the winding device, and to secure the "beginning" of the material web so that with the insertion of a new winding core, a new winding process can begin.

The wrapping web dispenser may include several wrapping web rolls that can be moved laterally to the travel direction of the material web and that can be dispensed to overlap one another, thereby forming an overlap region. As described above in connection with the process, a number of wound rolls can be simultaneously wrapped even if the width of the main roll from which the wound rolls are cut exceeds the width of an individual wrapping web. The wrapping web is then simply formed by a number of wrapping webs that are disposed next to each other in the axial direction and overlap one another.

It may be particularly preferable for the wrapping web dispenser to have a longitudinal gluing device. In some instances, it may be sufficient to allow the wrapping webs to simply overlap and to wind them with a certain tension. However, an even better wrapping can be achieved by gluing the adjacent wrapping webs to one another in their overlap region.

A control device may be provided, which keeps the overlap region(s) from being positioned at the longitudinal edges of the wound rolls. Since the overlap region forms a section of the wrapping web with double thickness, this measure ensures that the diameter increase of the wrapped wound roll caused by the overlap region is not located in an intrusive region. Thus, it is kept away from the edges of the wound roll.

The present invention provides a wound roll in which the width of the wrapping web precisely corresponds to the width of the wound roll and that the wrapping web, at least in one section, is located radially beneath the material web in the circumference direction.

A wound roll of this type can save space during its production because it is not necessary to store a large number of different widths of wrapping webs. Further, it is possible to regard the wrapping as a partial section of the winding. In this embodiment, in a section at the beginning or at the end of the winding or wrapping, it is practically inevitable that the wrapping web and the material web are disposed one on top of the other in the radial direction so that the wrapping web is disposed radially inside the material web.

In this regard, in a particular embodiment, the wound roll may have an outer layer that includes several alternating layers the material web and the wrapping web. In this embodiment, in order to finish the winding or to produce the wrapping web, the wrapping web and the material web are simply wound jointly.

In an alternative embodiment, the wrapping web forms a part of the innermost layer of the new wound roll. In this instance, a portion of the wrapping web has been left over from the wrapping of a previous wound roll that was wound in the same position as the new wound roll.

The present invention relates to a process for producing a wound roll that is wrapped on its circumference. The process includes winding a material web into the wound roll, attaching a wrapping web to the material web, and winding the wrapping web attached to the material web around the circumference of the wound roll.

According to another feature of the present invention, before winding the material web on the roll, the process may further include cutting the material web in a longitudinal direction. The wrapping web is attached to the material web before the cutting.

In accordance with another feature of the present invention, the process may further include attaching a trailing edge of the wrapping web to the material web. Further, the process may include jointly winding the wrapping web and the material web around the circumference of the wound roll. Still further, the process may include gluing the material web to a surface of the wound roll in a vicinity of the attachment of the trailing end of the wrapping web to the material web.

In accordance with still another feature of the present invention, the wrapping web may include a leading edge, and the attachment of the wrapping web to the material web can include attaching the leading edge of the wrapping web to the material web. The process may further include cutting the material web in a region downstream of the attachment of the leading edge of the wrapping web to the material web, thereby forming a trailing edge of the material web attached to the wrapping web and a leading edge of the material web. The process can further include cutting the wrapping web to form a trailing edge of the wrapping web, and attaching the trailing edge of the wrapping web to the leading edge of the material web. Further, the process may include attaching the trailing edge of the wrapping web to the circumference of the wound roll in a region upstream of the attachment of the trailing edge of the wrapping web and the leading edge of the material web. The process may also include weakening the wrapping web in a region between a region of the trailing edge for attachment of the wound roll and a region of attachment between the leading edge of the material web and the trailing edge of the wrapping web.

According to a further feature of the present invention, the process can also include attaching one of the material web and the wrapping web to a surface of the wound roll, and weakening the one of the material web and the wrapping web in a region after a region of the one of the material web and the wrapping web to be attached to the surface of the wound roll. The weakening can include perforating the one of the material web and the wrapping web. The winding may occur in a winding device, and the process may further include ejecting the wound roll from the winding device. In this manner, the weakened one of wrapping web and the material web is torn off.

According to a still further feature of the present invention, the wrapping web may be composed of a plurality of wrapping webs arranged next to one another and laterally to a travel direction of the wrapping webs. The plurality of wrapping webs can also be positioned to at least partially overlap each other to form an overlap region. The process can further include positioning the overlap region so as not to align with an edge of the wound roll.

The present invention also relates to an apparatus for producing a circumferentially wrapped wound roll. The apparatus includes a material web delivery path, a winding device, and an output path of a packaging web dispenser that feeds into the material web delivery path.

According to another feature of the present invention, a longitudinal cutting device can be arranged within the material web delivery path. The output path can be fed into the material web delivery path prior to the longitudinal cutting device.

According to a further feature of the present invention, a first glue delivery station may be located in a region downstream of where the output path of the packaging web dispenser feeds into the material web delivery path. Further, a nip may be formed between the wound roll and a roller, and a second glue delivery station may be located a region before the nip. Further still, a weakening device can be positioned in a vicinity of the second glue delivery station, and the weakening device can include a perforation device.

In accordance with a still further feature of the present invention, a winding bed can be provided, as well as a material web securing device located in an inlet region of the winding bed.

In accordance with another feature of the present invention, a plurality of wrapping web rolls can be provided which are laterally movable relative to the wrapping web travel direction and in which the wrapping webs are overlappingly positionable to form an overlap region. A longitudinal gluing device that glues the overlap region can be provided. A control device may be included that ensures that the overlap region is not located at an edge of the wound roll.

The present invention also relates to a process for circumferentially wrapping a wound roll in the above-described apparatus. The process includes feeding the material web along the material web delivery path toward the winding device, and feeding the output path of the packaging web dispenser into the material web delivery path.

According to still another feature of the present invention, the process may also include longitudinally cutting the material web delivery path downstream of a position at which the output path is fed into the material web delivery path.

According to a further feature of the present invention, the process can also include applying a first glue to the wrapping web in a region downstream of where the output path of the packaging web dispenser feeds into the material web delivery path. The process may also include forming a nip between the wound roll and a roller, and applying a second glue to one of the material web and the wrapping web in region before the nip. Still further, the process can include weakening the one of the material web and wrapping web in a vicinity of where the second glue is applied, and the one of the material web and wrapping web can be perforated.

In accordance with another feature of the present invention, the apparatus can further include a winding bed, and the process may further include securing the material web at an inlet region of the winding bed.

According to a still further feature of the present invention, the process can include laterally moving a plurality of wrapping web rolls to form an overlap region extending in a web travel direction. Further, the process can include longitudinally gluing the overlap region of adjacent wrapping webs. Still further, the process can include controlling a position of the overlap region so that it is not located at an edge of the wound roll.

The present invention also relates to a wrapped wound roll that includes a wound material web having a circumference covered by a wrapping web. A width of the wrapping web which corresponds to a width of the wound roll. Moreover, the wrapping web is arranged such that in at least one section, the wrapping web is positioned radially inside of the material web.

In accordance with another feature of the present invention, an outer layer is provided that can include alternatingly repeating layers of material web and wrapping web.

According to still another feature of the present invention, an innermost layer is provided that may include the wrapping web.

In accordance with yet another feature of the present invention, the width of the wrapping web precisely corresponds with to the width of the wound roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1A:
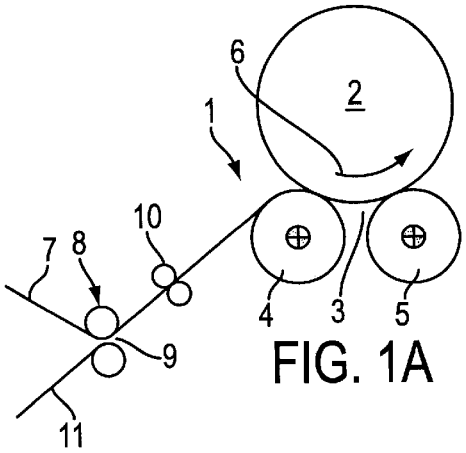
FIGS. 1A–1J schematically illustrate a first embodiment of the process and apparatus of the present invention for producing a wrapped wound roll.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention provides a process and device for winding and wrapping a material web roll. In the exemplary embodiments discussed herein, the material web is described as a paper web. However, it is noted that this description is intended for the purpose of explanation and should not be construed as limiting. In particular, it is noted that the features of the present invention are applicable with other material webs, e.g., foils made of plastic or metal, cardboard webs, etc.

FIGS. 1A–1J illustrate a winding station 1 in which a wound roll 2 is arranged within a winding bed 3. Winding bed 3 can be formed by carrying rollers 4 and 5, of which at least one, and preferably both, of carrying rollers 4 and 5 are driven rollers. In winding bed 3, wound roll 2 is rotatable in the direction of arrow 6, and, during rotation, pulls material web 7 onto itself, i.e., material web 7 is wound onto wound roll 2 via rotation of wound roll 2.

In this manner, material web 7 is guided through a supply path which includes a deflection roll pair 8 and a longitudinal cutting device 10. Deflection roll pair 8 can form a closable nip 9, through which material web 7 is guided. Longitudinal cutting device 10 is arranged in a known manner to cut material web 7 into a plurality of partial webs. Accordingly, the longitudinal cutting device 10 has not been illustrated in FIGS. 1B–1J for the purposes of clarity.

Material web 7 can be, e.g., unwound from a main roll (not shown) and cut into partial webs having widths that correspond to the widths of the wound rolls to be produced by appropriate setting of longitudinal cutting device 10. The partial webs are wound into a plurality of wound rolls 2 arranged one after the other in the axial direction in winding bed 3.

When wound roll 2 has reached its final diameter, which can be, e.g., within a range of between approximately 0.8 and 1.5 m, it must be wrapped.

In this regard, a wrapping (packaging) web or sheet 11, e.g., a wrapping or packaging paper, is dispensed by a wrapping web dispenser (not shown). The wrapping web 11 may be guided along an output path until it reaches nip 9 of the deflection roller pair 8. The device for outputting wrapping web 11 along an output path is generally known in the art, and may include, e.g., air baffles, belts, or the like.

For the sake of clarity and explanation, in FIGS. 1A–1J, wrapping web 11 is depicted with a somewhat thicker line than material web 7.

Figure 1D:
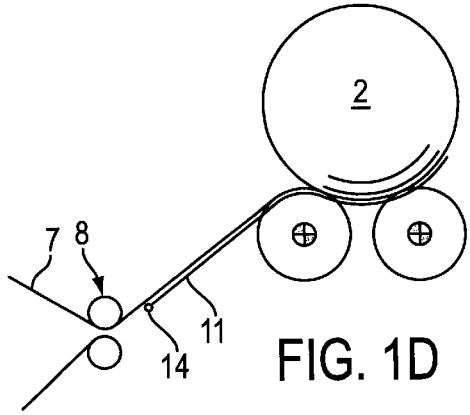
Figure 1B:
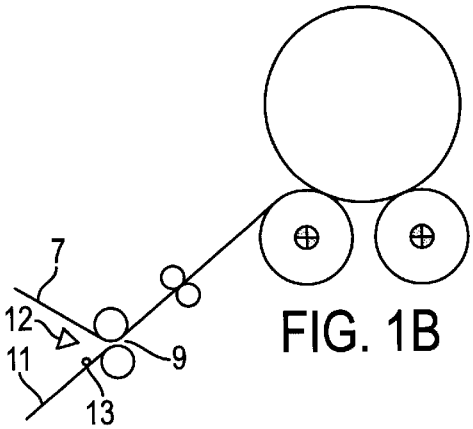
Figure 1E:
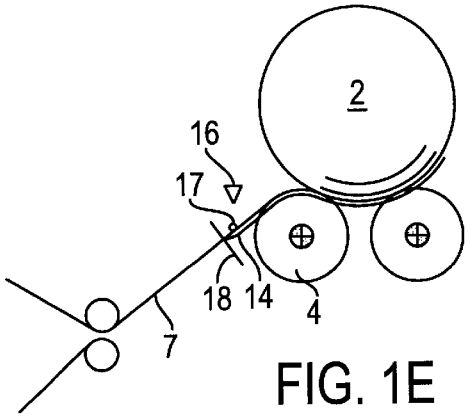

FIG. 1B illustrates a first glue delivery station 12 located just before nip 9 to apply a glue 13 to wrapping web 11. For the sake of explanation, glue 13 is depicted here as a dot, however, it is conceivable that glue 13 can extend over a greater area of the wrapping web, e.g., over approximately 100 mm in the web travel direction.

Figure 1C:
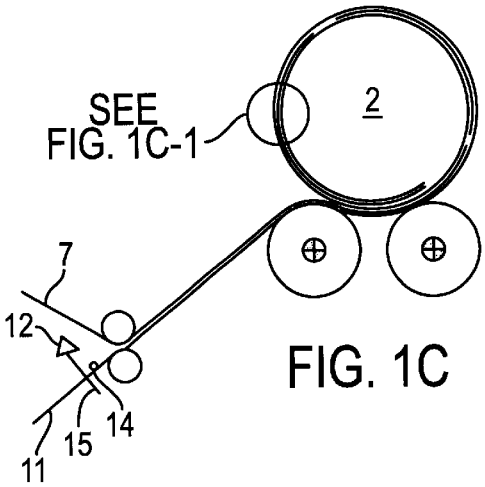

In FIG. 1C, nip 9 can be closed such that material web 7 and wrapping web 11 are both located within closed nip 9. While material web 7 is pulled by wound roll 2, material web 7 will carry wrapping web 11 through nip 9 via frictional adhesion and will subsequently carry wrapping web 11 by glued adhesion due to glue 13. For the purposes of ease of illustration and explanation, nip 9 is not shown as closed in FIG. 1C and a separation is shown between wrapping web 11 and material web 7. It is noted that in practice, nip 9 is in fact closed, and little if any gap is provided between the web 11 and 7.

Wrapping web 11 can now be jointly wound with material web 7 around wound roll 2 when wound roll 2 is rotated further in the direction of arrow 6. Wound roll 2 may then be provided with an outer layer that is composed of alternating layers of material web 7 and wrapping web 11, as shown in the detailed inset of FIG. 1C-1. While in at least a portion of the outer layers material web 7 is located radially outside of wrapping web 11, wrapping web 11 always forms the radially outermost layer.

If the necessary number of wrapping web layers have been wound around the wound roll 2, e.g., approximately four layers, then glue delivery station 12 can apply an additional amount of glue 14 onto wrapping web 11. A cutting device 15, the details of which are not shown, is positioned such that after the application of glue 14 by glue delivery station 12, wrapping web 11 is cut, i.e., wrapping web 11 is cut in a region downstream of applied glue 14 in relation to the web travel direction. As a consequence, material web 7 is glued once more to the end of wrapping web 11 as the region of wrapping web 11 with applied glue 14 passes through closed nip 9 of deflection roller pair 8. The cut edge of wrapping web 11, i.e., a leading edge for the next wrapping web (which is downstream from glue 14), can be held fast before nip 9 to be subsequently supplied to the nip when needed by known threading devices, e.g., air baffles, suction belts, or the like. Alternatively, the leading edge of the next wrapping web can be conveyed to the bottom roller of deflection roller pair 8 immediately after the cutting and can be either clamped in place or held in place via suction. Should the need arise, the cutting can also be carried out directly on the bottom roller of deflection roller pair 8, e.g., if this bottom roller has an appropriate slot into which a strike-off blade or another cutting device can enter.

Naturally, it is also possible to glue material web 7 and wrapping web 11 together over their entire length, so as to produce a type of "armored wrapping" with a stable circumference covering.

FIG. 1D shows that material web 7, together with the end, i.e., trailing edge, of wrapping web 11, is pulled further onto wound roll 2. With the aid of known devices, the beginning of the next wrapping web 11 is conveyed into the region of nip 9 of deflection roller pair 8.

A second glue delivery station 16 may be located just before first carrying roll 4 to apply a third amount of glue 17 onto the radial inside surface of material web 7, i.e., onto the surface which will come into contact with the circumferential surface of wound roll 2. Glue 17 may be located opposite glue 14. It is also not necessary that glue 17 is applied in a linear fashion, but rather that it extend over an area that corresponds to the area of glue 14.

A perforation device 18, the details of which are not shown, may be positioned such that, in a region after application of glue 17 by glue delivery station 16, relative to the web travel direction, material web is perforated over its entire width.

After the perforation of material web 7, if wound roll 2 is rotated further (see FIG. 1F), material web 7, via glue 17, adheres to the circumference of wound roll 2, i.e., material web 7 adheres to the penultimate layer of wrapping web 11. Moreover, with the aid of glue 14, the outermost layer of wrapping web 11 adheres to the outermost layer of material web 7. Both glue points are pressed together when material web 7 and wrapping web 11 pass through a nip between carrying roller 4 and wound roll 2.

Figures 1, 1C:
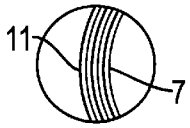
Figure 1F:
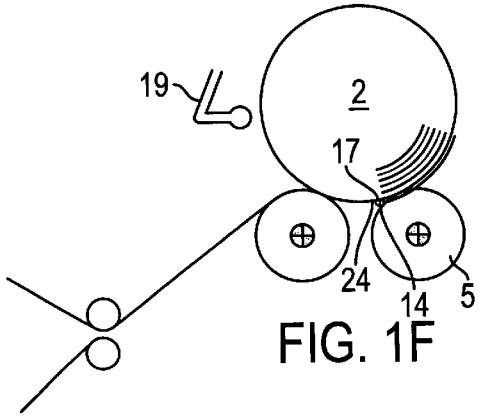
Figure 1G:
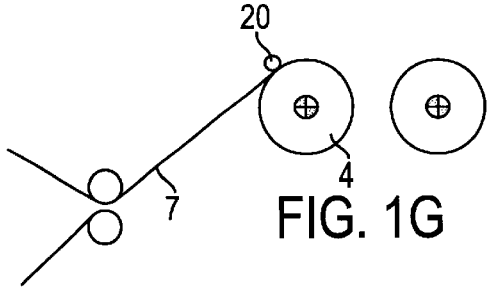
Figure 1H:
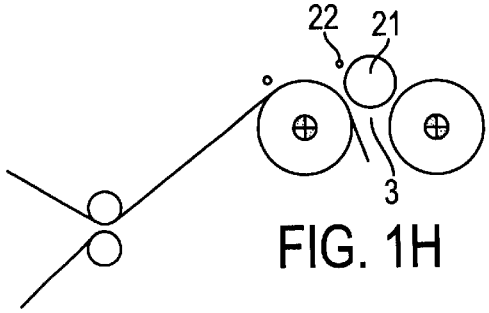

When wound roll 2 has achieved the state depicted in FIG. 1F, the driving of carrying rollers 4 and 5 can be stopped and wound roll 2 can be ejected with the aid of an ejector 19. In this manner, the perforation tears, and a leading edge of material web 7 to be wound, remains. So that this edge does not slip down from this position, a securing device 20 may be provided to secure material web 7 on carrying roller 4, as shown in FIG. 1H.

Figure 1I:
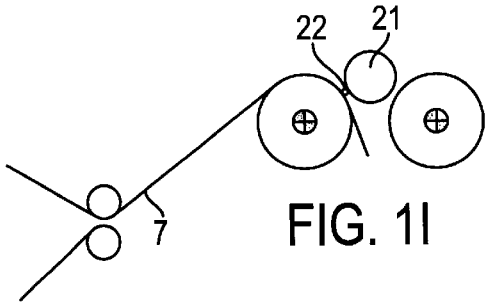
Figure 1J:
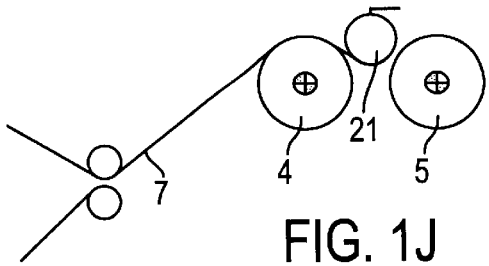

A prepared winding sleeve 21 can be inserted into winding bed 3 as a core for winding a next wound roll. Winding sleeve 21 can already have a glue point 22 applied thereto. If carrying rollers 4 and 5 are again set into motion, then glue point 22 can come into contact with material web 7 and attach material web 7 to winding sleeve 21, as shown in FIG. 1I. If carrying rollers 4 and 5 are further rotated, then material web 7 begins to wind onto winding sleeve 21, as shown in FIG. 1J.

Naturally, the first and second glue delivery stations 12 and 16 can also be permanently or continuously in operation during the production of the circumference wrapping so that the entire wrapping is glued to the wound roll 2 to be wrapped.

In the exemplary embodiment according to FIGS. 1A–1J, a circumference wrapping with a sandwich-like structure is produced, i.e., in which layers of material web 7 and of wrapping web 11 are altematingly arranged in the radial direction. In this manner, even if the wrapping has only slightly more than one layer, it is always provided that at least a portion of wrapping web 11 is arranged radially inside a layer or part of a layer of material web 7.

FIGS. 2A–2F illustrate an exemplary embodiment in which the wrapping is provided only by wrapping web 11, i.e., without material web layers being disposed between layers of the wrapping web.

The same parts are provided with the same reference numerals.

Figure 2A:
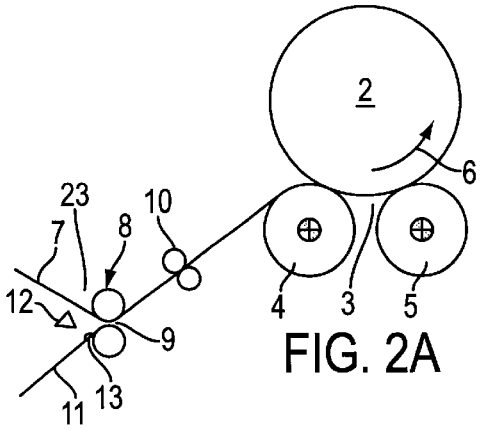
FIGS. 2A–2F schematically illustrates a second embodiment of the process and the apparatus according to present invention.

In accordance with FIG. 2A, a cutting device 23, which is not shown in detail, for material web 7 is positioned before nip 9 of deflection roller pair 8. In lieu of cutting device 23, a cutting device can be provided that cooperates with the top roller of deflection roller pair 8. In this instance, the beginning of material web 7 for the next wound roll, i.e., the leading edge of material web 7 arranged downstream from cutting device 23, can be clamped to, suctioned against, or secured in some other manner to the deflection roller, so that material web 7 can be conveyed further when nip 9 closes.

Figure 2E:
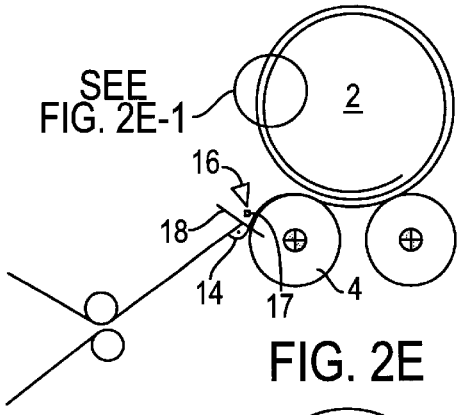
Figures 1, 2E:
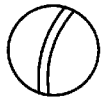
Figure 2F:
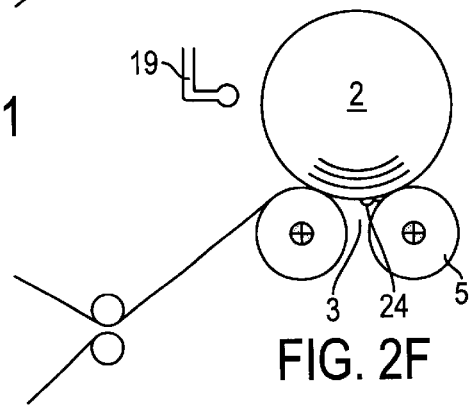
Figure 2B:
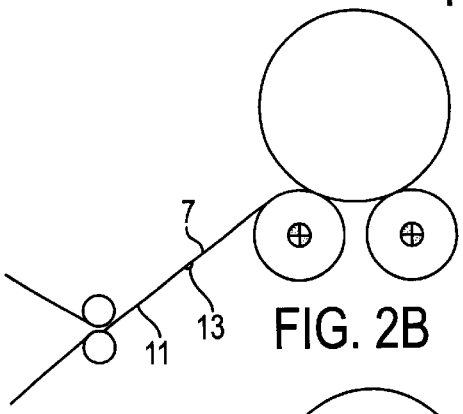

If wound roll 2 has reached its desired diameter, glue delivery station 12 is activated to apply glue 13 onto wrapping web 11. At the same time, or shortly thereafter, material web 7 is cut by cutting device 23. FIG. 2B shows that the beginning of wrapping web 11 is glued to the end, i.e., trailing edge, of material web 7 via glue 13.

Figure 2C:
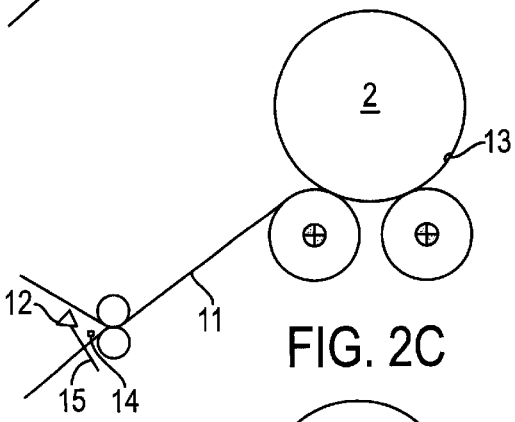

Upon further rotation of the wound roll 2, wrapping web 11 is pulled onto the circumference of wound roll 2, as illustrated in FIG. 2C.

Figure 2D:
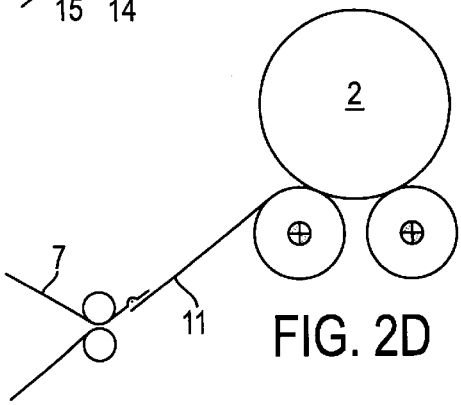

If the necessary number of wrapping web layers have now been wound onto the circumference of wound roll 2, cutting device 15 may be activated to cut wrapping web 11. Moreover, a second amount of glue 14 can be applied to the trailing edge of wrapping web 14, i.e., the edge upstream of cutting device 15, such that, upon passing through nip 9, the trailing edge of wrapping web 11 is attached to the beginning or leading edge of material web 7, as shown in FIG. 2D.

If the end of wrapping web 11 has reached second glue delivery station 16, a third amount of glue 17 can be applied, e.g., directly onto wrapping web 11 upstream from the attachment point of the leading edge of material web 7. At the same time, perforation device 18 can perforate wrapping web 11 between third glue 17 and second glue 14, as shown in FIG. 2E. Inset FIG. 2E-1 illustrates the wrapping of material web 7 prior to wrapping on of wrapping web 11.

Wound roll 2 can be further rotated such that third glue 17 passes through the nip between wound roll 2 and carrying roller 4. As a result, wrapping web 11 adheres to the circumference of wound roll 2. Wound roll 2 can then be further rotated until perforation line 24 is located just before of carrying roller 5. If wound roll 2 is now ejected with the aid of ejector 19, the perforation in wrapping web 11 will tear and the front end (leading edge) of material web 7 with at least a portion of the trailing edge of wrapping web 11 remaining attached thereto, is positioned in winding bed 3.

The remainder of process is then substantially the same as described with reference to FIGS. 1G to 1J. When a new wound roll is wound, the remainder of wrapping web 11 is located at the core.

Both of the above-described processes can simultaneously wrap a number of wound rolls in such a manner that the applied wrapping web has the same width as the respective wound roll. In this connection, the present invention is not limited to the described double carrying roller winder. For example, the feature of the present invention can also be practiced using support roller winders, in which the wound rolls rest on a support roller in alternating gaps relative to one another, i.e., the fundamental process remains the same.

Figure 3A:
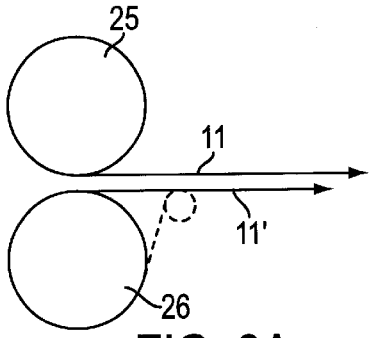
FIGS. 3A and 3B schematically illustrate an alternative formation of the wrapping web.
Figure 3B:
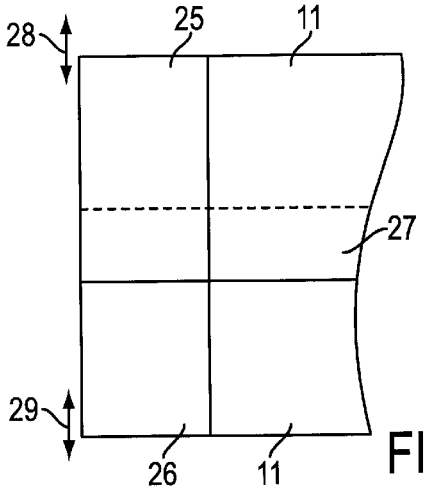

If the main roll has a width greater than the widest available wrapping web, then two or more wrapping web rolls 25 and 26 must be arranged next to each other so to form a wrapping web with an appropriate width, as shown in FIGS. 3A and 3B. Thus, wrapping web rolls 25 and 26 are arranged to overlap one another, thereby forming an overlap region 27. In overlap region 27, wrapping webs 25 and 26 can be attached to each other with adhesive.

Both wrapping web rolls 25 and 26 can be moved in the directions of arrows 28 and 29, so as to ensure that overlap region 27 is not cut in the longitudinal direction, i.e., is never positioned at an edge of a wound roll 2. However, it is acceptable to position overlap region 27 in an axial center of wound roll 2. In this regard, if edge strips are later applied to the wrapped wound roll to protect the edges and to attach an end cover, then the diameter increase caused by the double layer of overlap region 27 does not play any greater role.

In lieu of unwinding of wrapping web rolls 25 and 26 in the manner depicted in FIG. 3A, both wrapping web rolls 25 and 26 can be unwound in a same rotation direction. In this instance, it can be ensured that the same sides, e.g., the radial insides or radial outsides, of wrapping web 11 and 11' are oriented in the same direction. Not only does this standardize the appearance of the wrapping web, but the quality of the wrapping is also the same then for all wound rolls 7 wrapped in the winding device.

Figure 4:
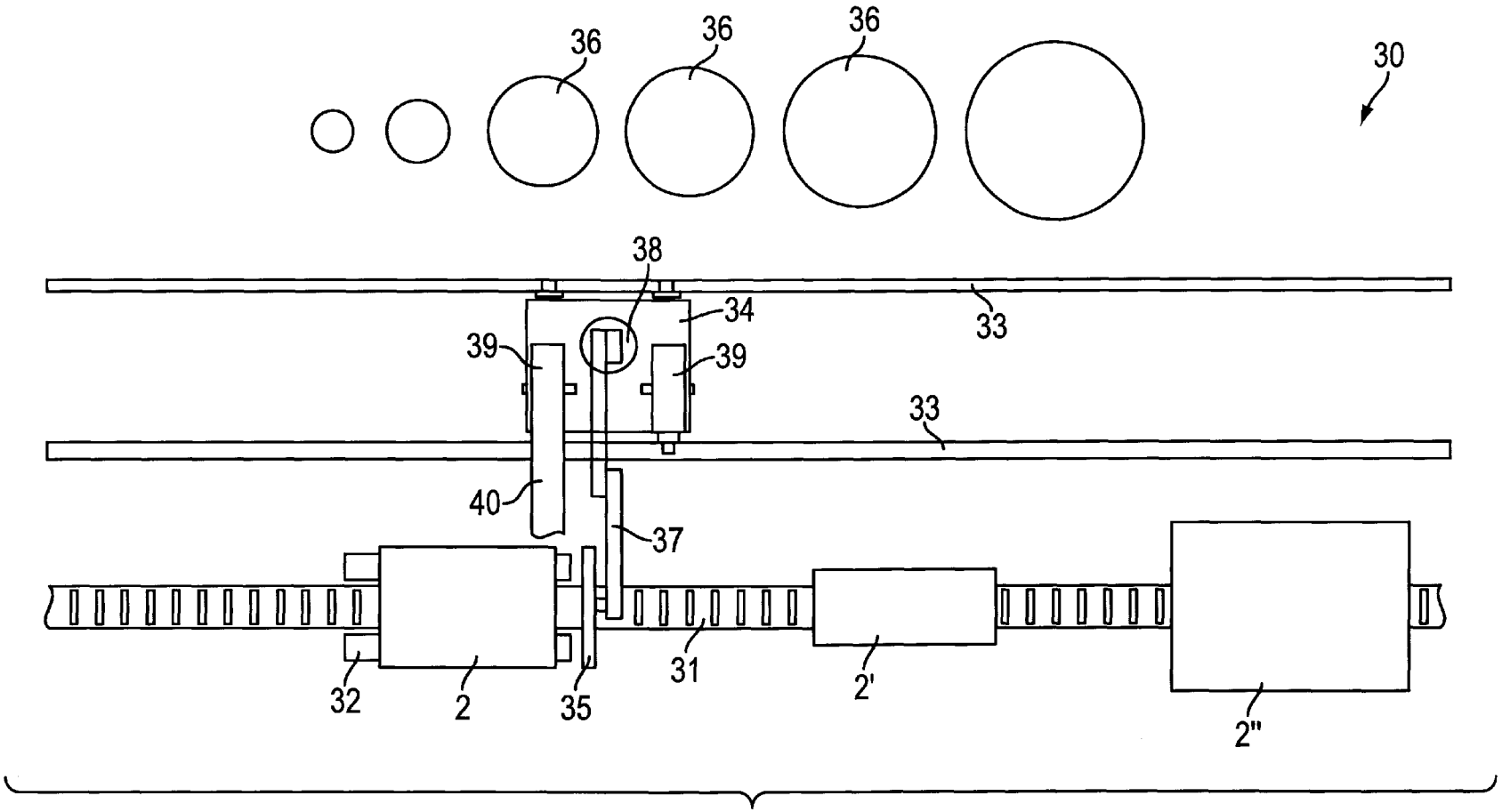
FIG. 4 schematically illustrates an end face wrapping station.

FIG. 4 illustrates another component of a wrapping device, i.e., an end wrapping device 30. On a roll track 31, wound material web rolls 2, 2', and 2" can be supplied in series to a carrying roller pair 32. In order to clarify the situation, wound rolls 2, 2', and 2" can have different diameters and if necessary, can also have different axial lengths. However, if all of the winding rolls from one "batch", i.e., all of the jointly wound winding rolls, are supplied in sequence, they naturally have at least essentially the same diameter.

Wound roll 2 can be placed on carrying roller pair 32. If necessary, the roll can be lifted for this purpose.

A pair of rails 33 are arranged on the side next to carrying roller pair 32 and essentially parallel to it so that a cart 34 can travel on these rails, parallel to the axis of wound roll 2. An end cover supply device 35 is arranged on cart 34 and is positionable to pick up end covers 36 that are stacked with different diameters next to one another on the other side of rail pair 33 and to supply the end covers 36 to ends of wound roll 2. In the exemplary operating state, the right end of wound roll 2 is supplied with an end cover. The end cover supply device 35 has a pivot arm 37 for this purpose, which can be pivoted in a plane substantially perpendicular to the pair of rails 33, and can also be rotated by 180°. This rotation can if necessary also be produced through cooperation with a rotary table 38 on cart 34. Its rotational motion then cooperates with a pivoting motion of pivot arm 37.

Edge strip dispensers 39 are located on both sides of pivot arm 37. The left edge strip dispenser 39 can dispense an edge strip 40, which is supplied via known devices which are not shown in detail to the right axial end of wound roll 2. Edge strip 40 can be attached to the circumference of wound roll 2 so that it protrudes slightly in the axial direction. If this protrusion is folded onto the end face of wound roll 2, it can secure end cover 36.

A right edge strip dispenser 39 may be correspondingly provided for left end of wound roll 2.

On the whole, therefore, the depicted wrapping process can realize a considerable time savings due to the fact that the circumference wrapping is applied simultaneously for all wound rolls that are disposed in a winding station. Thus, it is only necessary that the edge wrapping takes place separately for each wound roll 2.

Further, with the aid of edge strips, the edge wrapping can now be made so thick that a diameter increase possibly located in the axial center of a wound roll, which was produced by combining two wrapping webs, is no longer a factor because the diameter increase due to edge strips 40 is even greater.

Naturally, a winding station 1 can also be associated with two end cover placement and supply stations 30 in order to further accelerate the wrapping process. In many instances, however, this is not necessary because the time required to wind the next batch of wound rolls 2 is sufficient for providing all of the wrapped wound rolls with edge strips 40.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for producing a wound roll that is wrapped on its circumference, comprising:

winding a material web into the wound roll;

attaching a wrapping web to the material web at a location remote from the wound roll, whereby the material web guides the wrapping web toward the wound roll; and winding the wrapping web attached to the material web around the circumference of the wound roll.

2. The process according to claim 1, wherein, before winding the material web on the roll, the process further comprises:

cutting the material web in a longitudinal direction, wherein the wrapping web is attached to the material web before the cutting.

3. The process according to claim 1, further comprising attaching a trailing edge of the wrapping web to the material web.

4. The process according to claim 3, further comprising jointly winding the wrapping web and the material web around the circumference of the wound roll.

5. The process according to claim 3, further comprising gluing the material web to a surface of the wound roll in a vicinity of the attachment of the trailing end of the wrapping web to the material web.

6. The process according to claim 1, wherein the wrapping web includes a leading edge, and the attachment of the wrapping web to the material web comprises attaching the leading edge of the wrapping web to the material web, and the process further comprises:

cutting the material web in a region downstream of the attachment of the leading edge of the wrapping web to the material web, thereby forming a trailing edge of the material web attached to the wrapping web and a leading edge of the material web;

cutting the wrapping web to form a trailing edge of the wrapping web; and attaching the trailing edge of the wrapping web to the leading edge of the material web.

7. The process according to claim 6, further comprising attaching the trailing edge of the wrapping web to the circumference of the wound roll in a region upstream of the attachment of the trailing edge of the wrapping web and the leading edge of the material web.

8. The process according to claim 7, further comprising weakening the wrapping web in a region between a region of the trailing edge for attachment of the wound roll and a region of attachment between the leading edge of the material web and the trailing edge of the wrapping web.

9. The process according to claim 1, further comprising:

attaching one of the material web and the wrapping web to a surface of the wound roll; and weakening the one of the material web and the wrapping web in a region after a region of the one of the material web and the wrapping web to be attached to the surface of the wound roll.

10. The process according to claim 9, wherein the weakening comprises perforating the one of the material web and the wrapping web.

11. The process according to claim 9, wherein the winding occurs in a winding device, and the process further comprises:

ejecting the wound roll from the winding device, whereby the weakened one of wrapping web and the material web is torn off.

12. The process according to claim 1, wherein the wrapping web is composed of a plurality of wrapping webs arranged next to one another and laterally to a travel direction of the wrapping webs and positioned to at least partially overlap each other to form an overlap region, the process further comprising:

positioning the overlap region so as not to align with an edge of the wound roll.

13. A process for a circumferentially wrapped wound roll in an apparatus that includes a material web delivery path, a winding device, and a packaging web dispenser having an output path arranged to feed a packaging web into the material web delivery path, the process comprising:

feeding the material web along the material web delivery path toward the winding device; and feeding a packaging web along the output path of the packaging web dispenser into the material web delivery path.

14. The process according to claim 13, further comprising longitudinally cutting the material web fed along the material web delivery path downstream of a position at which the output path feed the packaging web into the material web delivery path.

15. The process according to claim 13, further comprising applying a first glue to the wrapping web in a region downstream of where the output path of the packaging web dispenser feeds into the material web delivery path.

16. The process according to claim 15, further comprising:

forming a nip between the wound roll and a roller; and applying a second glue to one of the material web and the wrapping web in region before the nip.

17. The process according to claim 16, further comprising weakening the one of the material web and wrapping web in a vicinity of where the second glue is applied.

18. The process according to claim 17, wherein the one of the material web and wrapping web are perforated.

19. The process according to claim 13, wherein the apparatus further comprises a winding bed, and process further comprises:

securing the material web at an inlet region of the winding bed.

20. The process according to claim 13, further comprising laterally moving a plurality of wrapping web rolls to form an overlap region extending in a web travel direction.

21. The process according to claim 20, further comprising longitudinally gluing the overlap region of adjacent wrapping webs.

22. The process according to claim 20, further comprising controlling a position of the overlap region so that it is not located at an edge of the wound roll.

23. An apparatus for producing a circumferentially wrapped wound roll, comprising:

a material web delivery path;

a winding device; and a packaging web dispenser having an output path arranged to feed a packaging web into the material web delivery path.

24. The apparatus according to claim 23, further comprising a longitudinal cutting device arranged within the material web delivery path; and wherein the output path is coupled to the material web delivery path prior to the longitudinal cutting device.

25. The apparatus according to claim 23, further comprising a first glue delivery station located in a region downstream of where the output path of the packaging web dispenser feeds into the material web delivery path.

26. The apparatus according to claim 25, further comprising:

a nip formed between the wound roll and a roller; and a second glue delivery station located in a region before the nip.

27. The apparatus according to claim 26, further comprising a weakening device positioned in a vicinity of the second glue delivery station.

28. The apparatus according to claim 27, the weakening device comprising a perforation device.

29. The apparatus according to claim 23, further comprising:

a winding bed; and a material web securing device located in an inlet region of the winding bed.

30. The apparatus according to claim 23, further comprising a plurality of wrapping web rolls which are laterally movable to the wrapping web travel direction and in which the wrapping webs are overlappingly positionable to form an overlap region.

31. The apparatus according to claim 30, further comprising a longitudinal gluing device that glues the overlap region.

32. The apparatus according to claim 30, further comprising a control device that ensures that the overlap region is not located at an edge of the wound roll.

* * * * *